United States Patent [19]

Fromm et al.

[11] Patent Number: 4,743,204

[45] Date of Patent: May 10, 1988

[54] AUXILIARY BOLT-OPERATED CONNECTION FOR PANELBOARD CIRCUIT BREAKER

[75] Inventors: Thomas L. Fromm, Charlottesville, Va.; Terry L. Tiede, Earlysville, Va.

[73] Assignee: Cooper Industries, Houston, Tex.

[21] Appl. No.: 914,854

[22] Filed: Oct. 3, 1986

[51] Int. Cl.[4] ..... H01R 13/639

[52] U.S. Cl. ..... 439/265; 439/807; 439/863

[58] Field of Search ..... 339/75 R, 75 M, 75 MP, 339/263 R, 263 L, 266 F, 270 R, 270 F, 273 R, 273 F, 273 S; 439/259, 265, 807, 863

[56] References Cited

U.S. PATENT DOCUMENTS

| | | | |
|---|---|---|---|
| 1,594,055 | 7/1926 | Filkins | 339/270 R |
| 1,610,044 | 12/1926 | Fortin | 339/270 R |
| 1,878,779 | 9/1932 | Jung et al. | 339/270 F |
| 2,126,674 | 8/1938 | Stout | 339/75 M |
| 3,496,521 | 2/1970 | Hohorst | 339/198 GA |
| 3,992,074 | 11/1976 | Rymer | 339/198 GA |

*Primary Examiner*—John McQuade

*Attorney, Agent, or Firm*—E. E. Scott; R. L. Maxwell

[57] ABSTRACT

An electric circuit breaker or switch is disclosed having a plug-in connection means with an auxiliary bolt-operated means for enhancing the electrical and mechanical connection between the circuit breaker and a panelboard terminal. A U-shaped terminal clip is mounted in an opening in the circuit breaker case. The terminal clip engages over and frictionally grips a stab terminal on a panelboard to provide an electrical connection. A C-shaped clamp fits over and partially encircles the terminal clip in such a manner that the free ends of the clamp arms project inwardly toward and contact the legs of the terminal clip. A screw, which may be non-conductive, is retained in a bore in the molded case of the circuit breaker, extends into the terminal clip opening and engages a threaded hole in the C-shaped clamp. Rotation of the screw draws the C-shaped clamp upwardly within the terminal clip opening and causes the clamp arms to move up onto wider, tapered portions of the clip legs thereby urging the legs of the clip into tighter engagement with the panelboard terminal.

16 Claims, 2 Drawing Sheets

AUXILIARY BOLT-OPERATED CONNECTION FOR PANELBOARD CIRCUIT BREAKER

BACKGROUND OF THE INVENTION

The present invention relates to electric switches, circuit breakers or current interrupters, and, more particularly, to a device for connecting a molded case electric circuit breaker to a stab terminal on an electric panelboard.

Several devices are currently utilized for connecting electric circuit breakers to electric panelboards. One common example is a plug-on connector, wherein the electrical connection is made by a resilient terminal clip having converging clamping arms that grip a stab terminal on a panelboard. In some constructions, a spring clip surrounds the terminal clip and enhances the connection. Typical plug-on connectors are disclosed in U.S. Pat. Nos. 4,020,400 and 3,383,486.

Plug-in connectors provide a convenient and space efficient means for connecting a circuit breaker to a panelboard; however, in some applications, a more conductive and sturdy connection is required. In addition, for certain applications, Underwriters Laboratories (UL) requires that circuit breakers using plug-in connectors be provided with an additional fastening means such that the circuit breaker requires more than a pull to release it from its mounted position on the panelboard.

In response to such requirements, some circuit breakers have been designed with a terminal lug which is secured to the panelboard terminal bus with a threaded fastener, such as a bolt or screw, to make the electrical connection between the circuit breaker and the panelboard. A device of this type is disclosed in FIG. 3 of U.S. Pat. No. 4,020,400. One disadvantage associated with the above-described bolt-on connection means is that additional space is required on the panelboard between rows of circuit breakers to provide access to the screws which fasten the terminal lug to the panelboard terminal bus. Such extra space increases material costs of the panelboard terminals, as well as the housings or enclosures therefor. Further disadvantages of circuit breakers having bolt-on lugs are that (1) such circuit breakers may only be installed on panelboards having terminals with appropriately sized threaded holes; (2) checking the tightness of the screw involves potential exposure to hazardous voltages; and (3) overtightening of the screw may damage the panelboard terminal.

Another prior art means of connecting electric circuit breakers to panelboards comprises a flexible bolt-on terminal tab adapted to be folded under the circuit breaker after the tab is secured to the panelboard terminal with a threaded fastener. U.S. Pat. No. 4,144,554 describes such an arrangement. With such flexible terminals, it is not necessary to leave a space between rows of circuit breakers. Although this device does not require as much space as the non-folding bolt-on terminal lugs, it is subject to the above-described disadvantages of bolt-on lug circuit breakers. Both the above-described prior art devices require the manufacture of differently constructed circuit breakers for the bolt-on and plug-in markets.

U.S. Pat. No. 3,538,390 describes a circuit breaker system having a terminal clip that may alternatively be used as a plug-in connector (FIG. 3) or as a bolt-on connector (FIG. 11). A disadvantage of such a system is that the circuit breaker terminal clip cannot be readily bolted to the panelboard terminal while it is being used as a plug-in connector. In order to function as a bolt-on connector, the circuit breaker terminal must be unbolted and removed from the circuit breaker and then bolted to the panelboard terminal and rebolted to the circuit breaker. As in the previously described bolt-on connectors, the panelboard terminal must be provided with a hole for the bolt, and checking the circuit breaker connection may involve a potentially hazardous exposure to high potentials.

All of the above-mentioned prior art devices are generally either not sufficiently secure for many applications, are not space efficient, or have other disadvantages as discussed above.

SUMMARY AND OBJECTS OF THE INVENTION

In view of the foregoing limitations and shortcomings of the prior art devices, as well as other disadvantages not specifically mentioned above, it should be apparent that there still exists a need in the art for a space efficient and convenient means for securely and conductively connecting an electric circuit breaker to a terminal on an electric panelboard. It is, therefore, a primary object of this invention to provide a convenient and efficient means for connecting an electric circuit breaker to a panelboard.

More particularly, it is an object of this invention to provide a circuit breaker having a plug-on terminal with an auxiliary means for securely tightening the connection of the circuit breaker to the panelboard terminal.

It is another object of this invention to provide an electric circuit breaker that can be used when either a plug-in or a bolt-on circuit breaker as required.

Yet another important object of this invention is to provide a circuit breaker which advantageously provides the convenience of installation and economy of space associated with a plug-on connection, yet also possesses the security of a bolt-on connection.

Still another object of this invention is to provide a bolt-on connection means for a circuit breaker, wherein the tightness of the bolted connection may be checked with minimum exposure of the user to hazardous voltages.

Another object of the present invention is to provide a bolt-on connection means for a circuit breaker that does not require a threaded hole in the panelboard terminal bus.

It is still a further object of this invention to provide a bolt-on connection means for a circuit breaker wherein the possibility of damage to the panelboard terminal bus due to overtightening of the bolt is eliminated.

Briefly described, these and other objects are accomplished according to the invention by providing a molded case plug-on circuit breaker that has an auxiliary bolt-operated means for tightening the electrical connection between the circuit breaker and the panelboard terminal. A generally U-shaped terminal clip is mounted in a stationary manner within an opening at the bottom of the circuit breaker case. The legs of the U-shaped terminal clip are adapted to slide over and frictionally engage the opposite sides of a stab terminal on a panelboard to provide an electrical connection in the same manner as a conventional plug-in circuit breaker.

A C-shaped clamp is fitted over and partially encircles the closed end of the terminal clip in such manner that the free ends or tips of the clamp arms project inwardly toward and engage the legs of the terminal clip. A threaded screw is retained at the bottom of a cylindrical counterbore in the molded case of the circuit breaker and extends into the terminal clip opening into threaded engagement with a threaded hole in the upper portion (or closed side) of the C-shaped clamp.

Rotation of the screw threads the same into the C-shaped clamp and draws it upwardly within the terminal clip opening and away from the clip. The upward movement of the clamp draws the clamp arms onto a wider portion of the terminal clip legs, thereby urging the legs into tighter engagement with the panelboard terminal. The screw, or at least a portion thereof, may be advantageously comprised of an electrically non-conductive material for greater safety.

With the foregoing and other objects, advantages and features of the invention that will become hereinafter apparent, the nature of the invention may be more clearly understood by reference to the following detailed description of the invention, appended claims, and to the several views illustrated in the attached drawings.

DETAILED DESCRIPTION OF A PREFERRED EMBODIMENT

Figure 1:
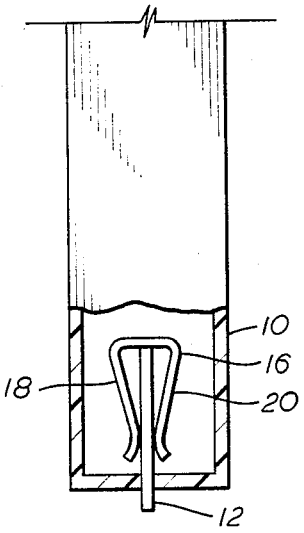
FIG. 1 (PRIOR ART)
FIG. 1 is a partially cut-away end view of a circuit breaker illustrating a conventional plug-in terminal clip.

Referring now in detail to the drawings, wherein like parts are designated by like reference numerals throughout, there is illustrated in FIG. 1, one prior art method of connecting a circuit breaker 10 to the stab terminal 12 by means of a spring clip 16. The legs 18, 20 of the clip 16 frictionally engage the stab terminal 12 to make an electrical plug-in connection therewith. Although such prior art plug-in connection means is convenient, it does not provide a sufficiently secure mechanical or adequate electrically conductive connection for many applications.

Figure 2:
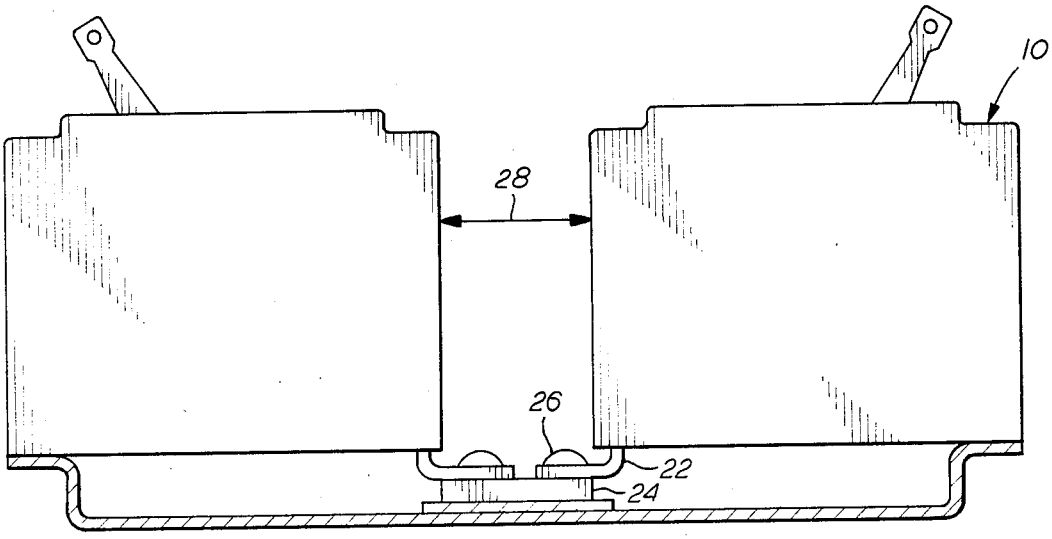
FIG. 2 (PRIOR ART)
FIG. 2 is a partially cut-away side view of a circuit breaker illustrating one form of a conventional bolt-on terminal.

For situations requiring a more secure and/or conductive connection, a bolt-on connection means shown in FIG. 2 has been used heretofore. In that device, an L-shaped terminal lug 22 is bolted to a panelboard terminal bus 24 by means of a screw 26. Although this device provides a better electrical and mechanical connection, it has several disadvantages, notably among them being the requirement that the panelboard terminals have properly sized threaded holes therein. Moreover, a space 28 is required adjacent each circuit breaker 10 to allow access for turning the screw with a screwdriver. Further disadvantages are that checking the tightness of the screw may involve a potentially hazardous exposure to high potentials, and that overtightening the screw may damage the panelboard terminal.

Figure 3:
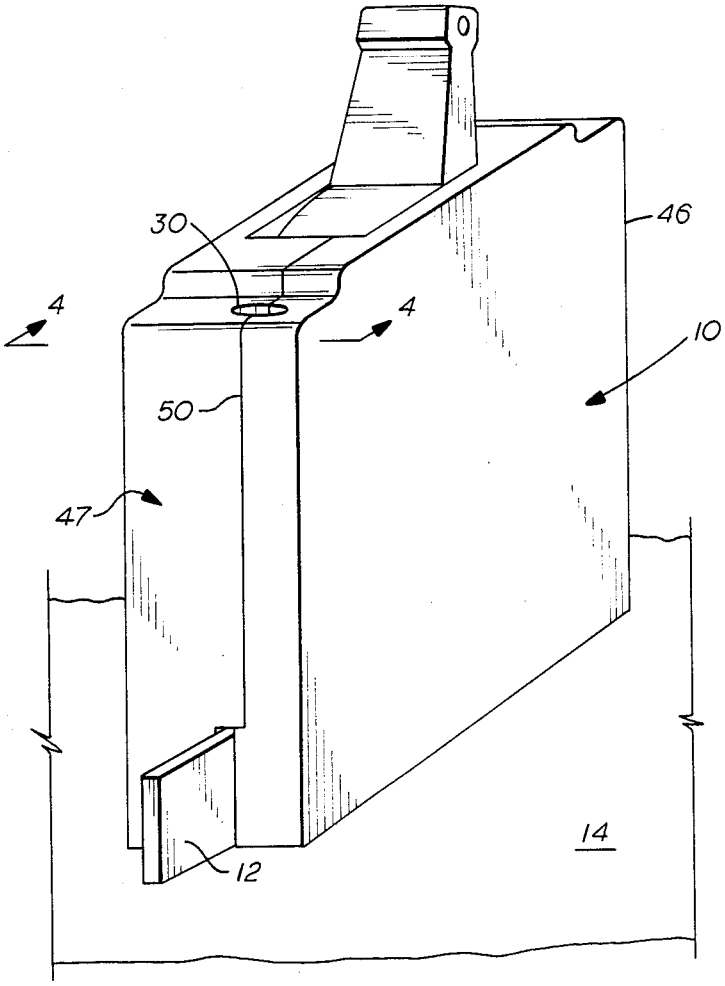
FIG. 3 is a perspective view of a circuit breaker in accordance with the present invention connected to a panelboard stab terminal.
Figure 4:
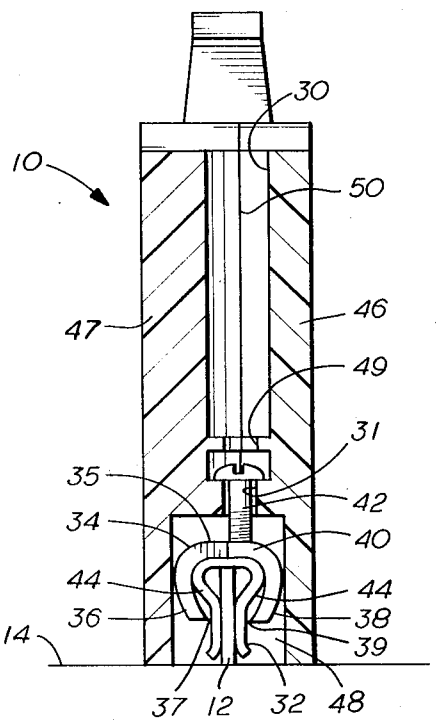
FIG. 4 is a cross-sectional view taken along line 4—4 of FIG. 3 showing the circuit breaker in a release mode.

The present invention advantageously combines the convenience of the FIG. 1 plug-in device with the mechanical and electrical security of the FIG. 2 bolt-on device. A circuit breaker embodying the present invention is illustrated in FIGS. 3 and 4 and comprises a circuit breaker 10 with a case molded in two parts 46, 47 which are mated together along interface 50. The circuit breaker 10 is connected to a panelboard stab terminal 12, which is, in turn, connected to a panelboard 14. A resilient, substantially U-shaped terminal clip 32 is electrically and mechanically connected to a circuit breaker 10 by conventional means (not shown). Such connection may be of any suitable construction and forms no part of the present invention. The terminal clip 32 is mounted in a stationary manner within an opening or cavity 48 in the molded circuit breaker case 46, 47, also in a conventional manner. As best seen in FIG. 4, the terminal clip 32 is adapted to be clipped over a vertical stab terminal 12 of a conventional panelboard 14. A substantially C-shaped clamp 34 is mounted over the terminal clip 32. The clamp 34 comprises an intermediate portion 35 with a threaded hole 40 disposed therein and inwardly converging arms 36, 38 extending from each end of the intermediate portion 35. The tips or free ends 37, 39 of the clamp arms, 36, 38 project inwardly toward and contact the legs of the terminal clip 32. The clamp 34 is made from either thicker or a more rigid material than the terminal clip 32 for reasons which will become apparent hereafter.

Figure 6:
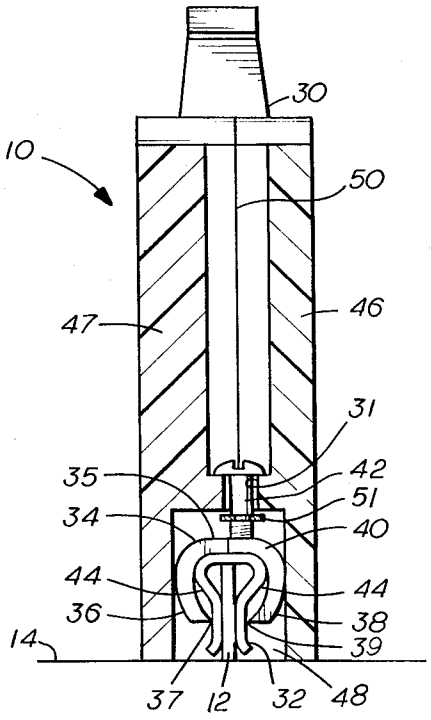
FIG. 6 is a cross sectional view as in FIG. 4 that has been modified to show alternative means for retaining a part of the present invention in proper position.

A cylindrical counterbore 30, 31 is molded in the case parts 46, 47 and extends into the terminal clip opening 48. Screw 42 is inserted in counterbore 30, 31 and threadably engages in the threaded hole 40 of the clamp. A portion of the bore 30 is provided with a diameter smaller than the diameter of the screw head, such as, for example, an internal annular ring or shoulder 49 which may be advantageously provided in the walls of the bore 30 when the case is molded. The screw 42 is thus retained within the counterbore 30, 31 by the interference between the screw head and the annular shoulder 49. If desired, instead of shoulder 49, a retaining ring 51 may be provided in a groove on the shank of the screw beneath the bore 31 to retain the screw therein. This alternative method of retaining screw 42 in place is shown in FIG. 6. The location and size of the bore 30 provides ready access to the head of the screw 42 by a screwdriver even when the circuit breaker 10 is mounted on a panelboard 14. Although the screw 42 extends into the threaded hole 40 in clamp 34, it is preferably of a length which does not contact the upper portion of the stationary terminal clip 32. The screw may also be provided with any conventional drive means such as a slot (as shown), a Phillips head or Allen (hex) head drive.

Since the screw itself forms no part of the electrical circuit between the contact 32 and the terminal 12, it may advantageously be made, in whole or in part, of an electrically insulative material, such as a polycarbonate plastic or the like. Alternatively, the screw 42 may be made of an electrically conductive material and a non-conductive driving member may be inserted permanently or temporarily in the bore 30. Any of those arrangements will eliminate the potential exposure to high voltages when tightening the bolt-on connection of the present invention.

Figure 5:
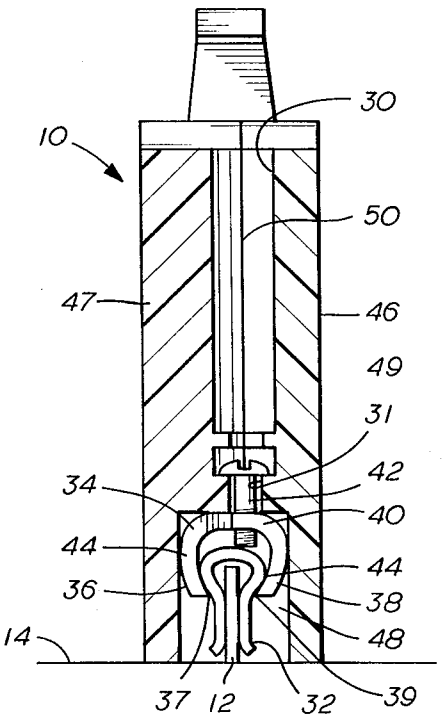
FIG. 5 is a cross-sectional view taken along line 4—4 of FIG. 3 showing the circuit breaker is a secured mode.

To use the circuit breaker of the present invention, a circuit breaker 10 embodying the inventive device is clipped onto a vertical stab terminal 12 in the same manner as a conventional plug-in circuit breaker and as shown in FIG. 4. A screwdriver or non-conductive driving element is inserted into the counterbore 30, 31 in casing 46, 47 and engages the head of screw 42. If the screw 42 has a right-hand thread, it is rotated clockwise, thus drawing the clamp 34 farther up onto the threaded portion of the screw 42. As the clamp 34 is drawn upwardly by the screw 42, the tips 37, 39 of the clamp arms 36, 38 engage the tapered portions 44 of the legs 18, 20 of the terminal clip 32 and force the legs of the terminal clip 32 into tighter mechanical engagement with the stab terminal 12 as shown in FIG. 5. Such tighter engagement provides a more conductive electrical connection between the stab terminal 12 and terminal clip 32, and provides a more secure mechanical connection that is less likely to become accidentally dislodged than a conventional plug-in connection.

To remove the circuit breaker 10 from the panelboard 14, a screwdriver or driving tool is used to turn the screw 42 in the opposite direction (i.e., counterclockwise, for a right-hand thread). As the screw 42 is backed out of the clamp 34, the screw head will engage the lower surface of annular shoulder 49 and then urge the clamp downwardly so that the force of the clamp arms 36, 38 is released from the terminal clip 32, thus loosening the connection between the two terminals 12 and 32. In the loosened condition of the terminal clip, the circuit breaker 10 can be pulled off the stab terminal 12 in the same manner as a conventional plug-in circuit breaker is removed from a stab terminal.

Although only a preferred embodiment is specifically illustrated and described herein, it will be appreciated that many modifications and variations of the present invention are possible in light of the above teachings and within the purview of the appended claims without departing from the spirit and intended scope of the invention.

What we claim is:

1. A device for making an electrical connection to a terminal, comprising:

a case;

a terminal clip having legs mounted within said case for engaging the terminal;

clamping means mounted in said case in operative relationship with said terminal clip, said clamping means comprising a clamp having an intermediate portion and inwardly converging arms extending from the intermediate portion, said arms straddling the legs of said terminal clip;

means mounted in said case for engaging said clamping means and urging said terminal clip into tighter engagement with the terminal.

2. The device of claim 1, wherein the electrical connection is for a circuit breaker and said terminal comprises a panelboard terminal.

3. The device of claim 1, wherein said terminal clip has inwardly converging legs and is substantially U-shaped.

4. The device of claim 1 wherein said engaging means is at least partially comprised of electrically non-conductive material.

5. The device of claim 1, wherein said case has a bore, a threaded hole in said clamping means, said engaging means comprising a screw mounted in said bore and engaging in the threaded hole in said clamping means.

6. The device of claim 5, wherein said screw has a head, at least a portion of said bore having a diameter smaller than the head of said screw for retaining said screw in said bore.

7. The device of claim 5, including retaining ring means on said screw for retaining said screw in said bore.

8. The device of claim 5, wherein said screw is at least partially comprised of electrically non-conductive material.

9. The device of claim 5, wherein said case has an opening therein, said terminal clip being stationarily mounted within said opening, said bore extending into said opening.

10. The device of claim 9, wherein said clamping means is mounted over and partially encircles said terminal clip whereby rotation of said screw urges the arms of said clamping means into progressively tighter contact with the legs of said terminal clip.

11. An electrical connection for enhancing the mechanical and electrical connection between a pair of terminals, comprising:

a first terminal having legs adapted to clip over a second terminal and make an electrical connection between the terminals;

clamping means mounted over said first terminal, said clamping means comprising an intermediate portion, inwardly converging arms extending from said intermediate portion, said arms straddling and engaging the legs of said first terminal;

means for drawing said clamping means against said first terminal so as to urge the legs of said first terminal toward each other and toward the second terminal to thereby enhance the mechanical and electrical connection between the first and second terminals.

12. The electrical connection of claim 11, wherein the first terminal is substantially U-shaped, the legs thereof being inwardly convergent.

13. The electrical connection of claim 11, including a case having an opening and a bore extending into said opening, said clamping means having a threaded hole, said first terminal being mounted in said opening, said drawing means comprising a screw mounted in said bore, said screw threadably engaging the hole in said clamping means, whereby rotation of said screw in one direction draws said clamping means into progressively tighter contact with the legs of said first terminal.

14. The electrical connection of claim 11, wherein said first and second terminals comprise circuit breaker terminals, said second terminal comprising a stab terminal on a panelboard.

15. The electrical connection of claim 13, wherein said screw has a head, at least a portion of said bore having a diameter smaller than the head of said screw for retaining said screw in said bore.

16. The electrical connection of claim 13, including retaining ring means on said screw for retaining said screw in said bore.

* * * * *